US007147573B2

(12) United States Patent
DiMarco

(10) Patent No.: US 7,147,573 B2
(45) Date of Patent: Dec. 12, 2006

(54) GOLF CLUB HEAD WITH ADJUSTABLE WEIGHTING

(75) Inventor: Thomas J. DiMarco, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 152 days.

(21) Appl. No.: 10/906,185

(22) Filed: Feb. 7, 2005

(65) Prior Publication Data

US 2006/0178228 A1 Aug. 10, 2006

(51) Int. Cl.
*A63B 53/04* (2006.01)
*A63B 53/06* (2006.01)
*A63B 53/08* (2006.01)

(52) U.S. Cl. ..... 473/324; 473/334; 473/335; 473/345; 473/349

(58) Field of Classification Search ..... 473/324, 473/334–339, 345–346, 349, 244–248, 256, 473/291
See application file for complete search history.

(56) References Cited

U.S. PATENT DOCUMENTS 1,879,117 A * 9/1932 Davidson ..... 473/247
2,691,525 A * 10/1954 Callaghan ..... 473/247
3,995,857 A 12/1976 Cochran et al.
4,008,896 A * 2/1977 Gordos ..... 473/336
4,763,899 A * 8/1988 Hundley ..... 473/256
4,895,371 A * 1/1990 Bushner ..... 473/336
5,282,625 A 2/1994 Schmidt et al.
5,447,309 A 9/1995 Vincent
5,769,737 A * 6/1998 Holladay et al. ..... 473/336
5,776,010 A 7/1998 Helmstetter et al.
5,785,605 A 7/1998 Helmstetter
6,210,290 B1 4/2001 Erickson et al.
6,217,461 B1 4/2001 Galy
6,277,032 B1 * 8/2001 Smith ..... 473/336
6,364,788 B1 4/2002 Helmstetter et al.
6,409,612 B1 6/2002 Evans et al.
6,440,009 B1 8/2002 Guibaud et al.
6,648,772 B1 11/2003 Vincent et al.
6,739,983 B1 5/2004 Helmstetter et al.
6,773,360 B1 8/2004 Willett et al.
6,860,818 B1 * 3/2005 Mahaffey et al. ..... 473/256
2002/0094884 A1 * 7/2002 Hocknell et al. ..... 473/334

* cited by examiner

*Primary Examiner*—Sebastiano Passaniti
(74) *Attorney, Agent, or Firm*—Michael A. Catania; Elaine H. Lo

(57) ABSTRACT

A golf club head (20) with an adjustable weight member (50) is disclosed herein. The weight member (50) is preferably positioned within a recess (40) of the golf club head (20). The weight member (50) is attached to a cable (42) and moved to a desired location and locked in place within a recess (40). The weight member (50) is preferably composed of a material having a greater density than the density of the material of a body (22) of the golf club head (20).

20 Claims, 10 Drawing Sheets

GOLF CLUB HEAD WITH ADJUSTABLE WEIGHTING

BACKGROUND OF THE INVENTION

1. Field of the Invention

The present invention relates to a golf club head with adjustable weighting. More specifically, the present invention relates to a golf club head that allows a golfer to modify the placement of mass.

2. Description of the Related Art

Numerous techniques have been used for weighting golf club heads in order to gain better performance. In persimmon wood club heads, weights were attached to the sole in order to lower the center of gravity. The first metal woods had sufficient weight, however, the weight distribution deterred slightly from performance. The refinement of hollow metal woods with weighting on the sole improved upon the performance of these clubs. An example of such woods were the GREAT BIG BERTHA® HAWK EYE® drivers and fairway woods, developed by the Callaway Golf Company of Carlsbad, Calif., that used a tungsten screw in the sole of each titanium club head body to vary the weight of the golf club head.

Another example is set forth in Helmstetter et al., U.S. Pat. No. 6,364,788 for a Weighting System For A Golf Club Head, which discloses using a bismuth material within an internal cavity to add mass to a golf club head, particularly a fairway wood.

Yet a further example is set forth in Evans et al., U.S. Pat. No. 6,409,612 for a Weighting Member For A Golf Club Head, which discloses a weighting device composed of a polymer body with ports to allow for placement of high density members such as tungsten spheres.

Another example of additional weighting of a golf club head is set forth in U.S. Pat. No. 5,447,309, which discloses the use of three weights fixedly disposed within the interior of a club head to provide a selected moment of inertia for the club head. Yet another example is set forth in British Patent Application Number 2332149 for a Golf Club Head With Back Weighting Member, which discloses a weight pocket in the exterior rear of a wood for placement of epoxy inserts that vary in density.

In irons, weighting of the club head has assumed many variations. One example is perimeter weighting in which the mass is shifted to the perimeter of the club head such as the BIG BERTHA® X-12® irons developed by the Callaway Golf Company and as set forth in U.S. Pat. No. 5,282,625. An example of additional weighting is set forth in U.S. Pat. No. 3,995,857 which discloses the placement of tungsten inserts into the rear of an iron.

Another example of additional weighting is the GREAT BIG BERTHA® TUNGSTEN-TITANIUM™ irons, developed by the Callaway Golf Company, which used a screw to attach a tungsten block to the rear and sole of a stainless steel iron as set forth in U.S. Pat. No. 5,776,010.

Yet another example is the GREAT BIG BERTHA® TUNGSTEN-INJECTED™ HAWK EYE® irons, also developed by the Callaway Golf Company, which feature an internal cavity with tungsten pellets in a solder, as set forth in U.S. Pat. No. 6,210,290, for a Golf Club And Weighting System. The weighting of putters has varied as with woods and irons.

An example of positioning mass in a golf club head for performance is disclosed in Helmstetter et al., U.S. Pat. No. 6,739,983 for a Golf Club Head With Customizable Center Of Gravity, which discloses a method and golf club head which allows a golfer to select a preferred center of gravity location for better ball striking.

A further example of positioning mass for performance is set forth in Helmstetter, U.S. Pat. No. 5,785,605 for a Hollow, Metallic Golf Club Head With Configured Medial Ridge, which discloses a golf club head with a center of gravity located in vertical alignment with a local zone defined by ridge on a sole of the golf club head.

However, prior technology have been similar in that the weighting means, whether it is a medallion, plug, insert or the like, is a static weight and mass. More precisely, once positioned on the club head, the weight does not change. If a new weight is desired, then the old weight is removed and an entirely new weight means is placed on the golf club head. The weights may be ground to remove mass in order to lower the weight, however, these prior art weights cannot easily have their mass increased by the addition of material.

Further, each of the prior art weighting means have a fixed and unchangeable center of gravity ("CG") and fixed and unchangeable moments of inertia ("MOI"). The CG cannot be moved and the MOI cannot be increased or decreased without dimensionally changing the prior art weighting means. Thus, the golf industry needs a weighting mechanism that allows for greater flexibility to adjust, the CG, MOI and also the swingweight on a golf club.

BRIEF SUMMARY OF THE INVENTION

One aspect of the present invention is a golf club head having a body and at least one weight member. The body has a face, a crown and a sole. The body also has an arc-like recess extending from a heel end of the body to a toe end of the body. The body also has a cable within the recess. The at least one weight member is attached to the cable and is movable within the arc-like recess to influence the center of gravity and other mass properties of the golf club head.

Another aspect of the present invention is a golf club head with a plurality of recesses. Within each recess is a weight member attached to a cable. The weight member is movable within each recess to influence the mass properties of the golf club head.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
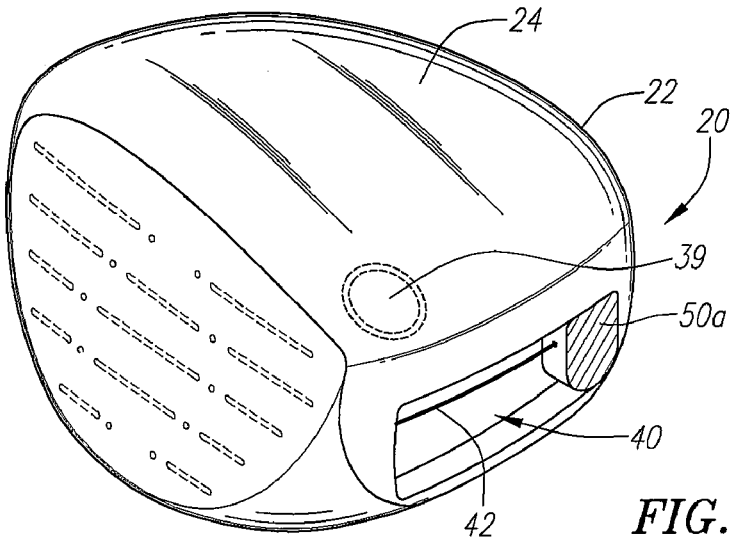
FIG. 1 is a top perspective view of a golf club head of the present invention.
Figure 2:
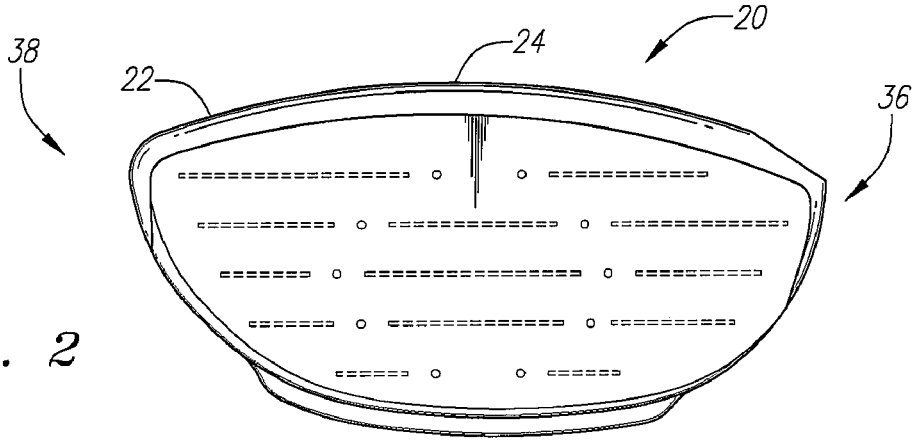
FIG. 2 is a front view of the golf club head of FIG. 1.
Figure 3:
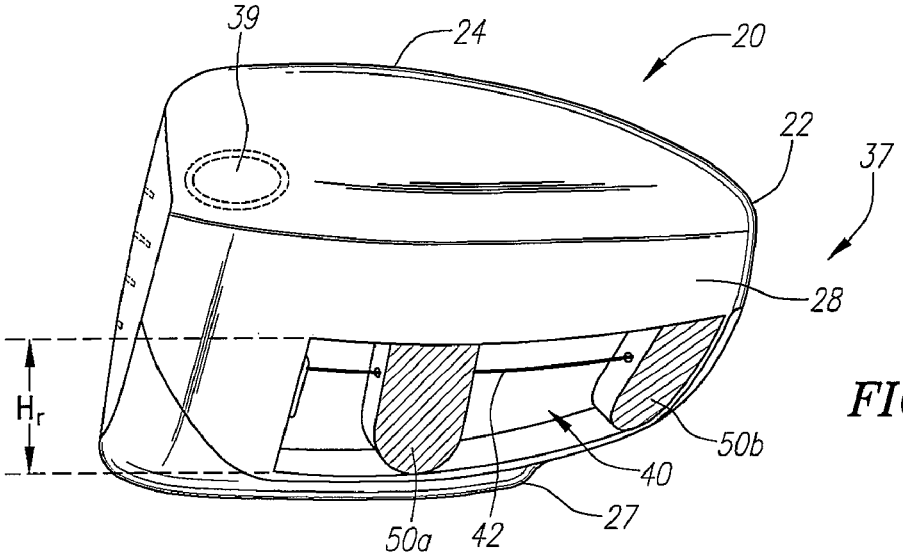
FIG. 3 is a heel side view of a golf club head of FIG. 1.
Figure 4:
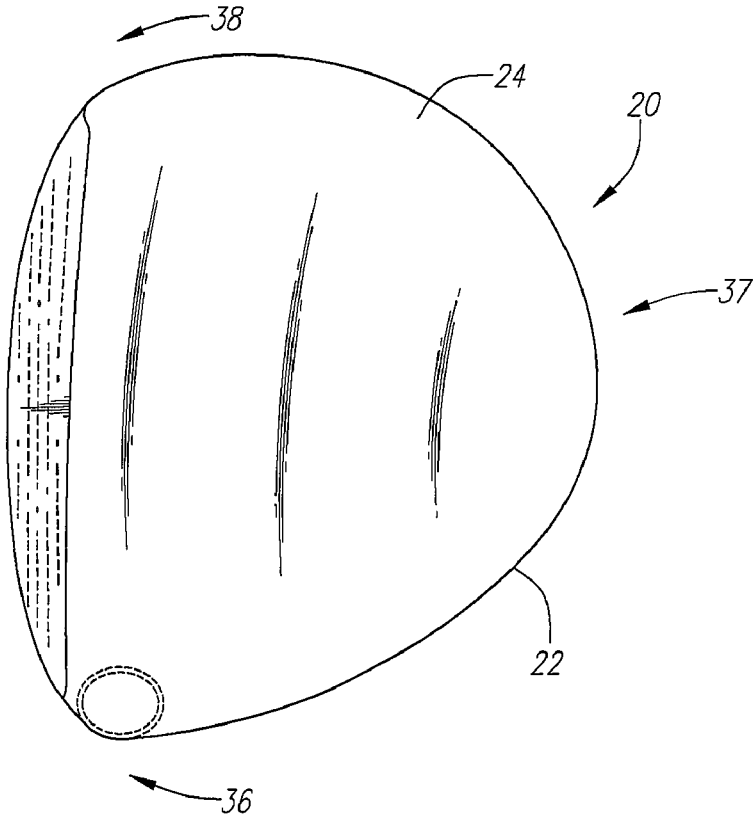
FIG. 4 is a top plan view of a golf club head of FIG. 1.
Figure 5:
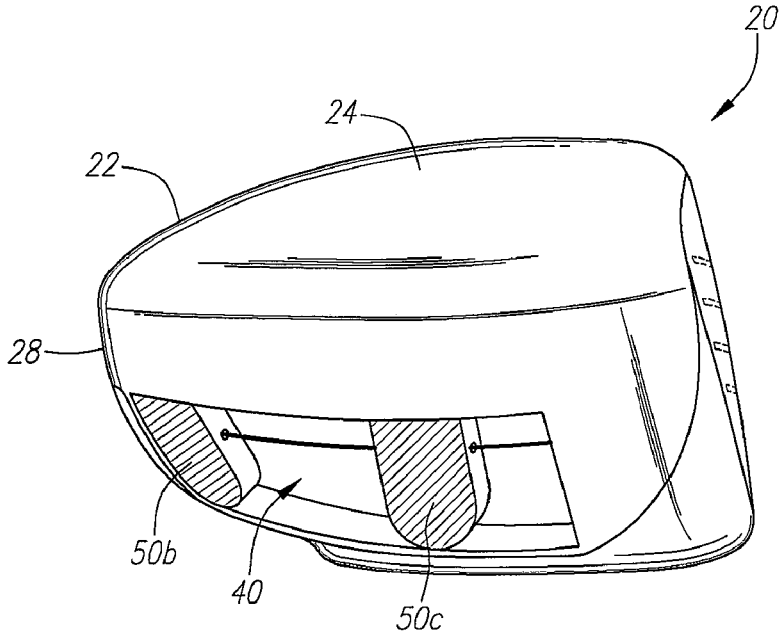
FIG. 5 is a toe side view of a golf club head of FIG. 1.
Figure 6:
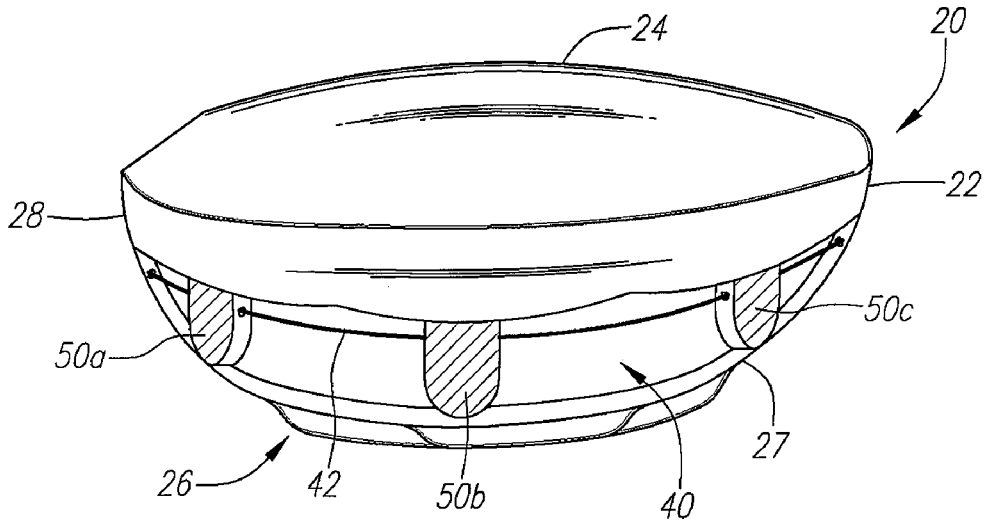
FIG. 6 is a rear view of a golf club head of the present invention.
Figure 7:
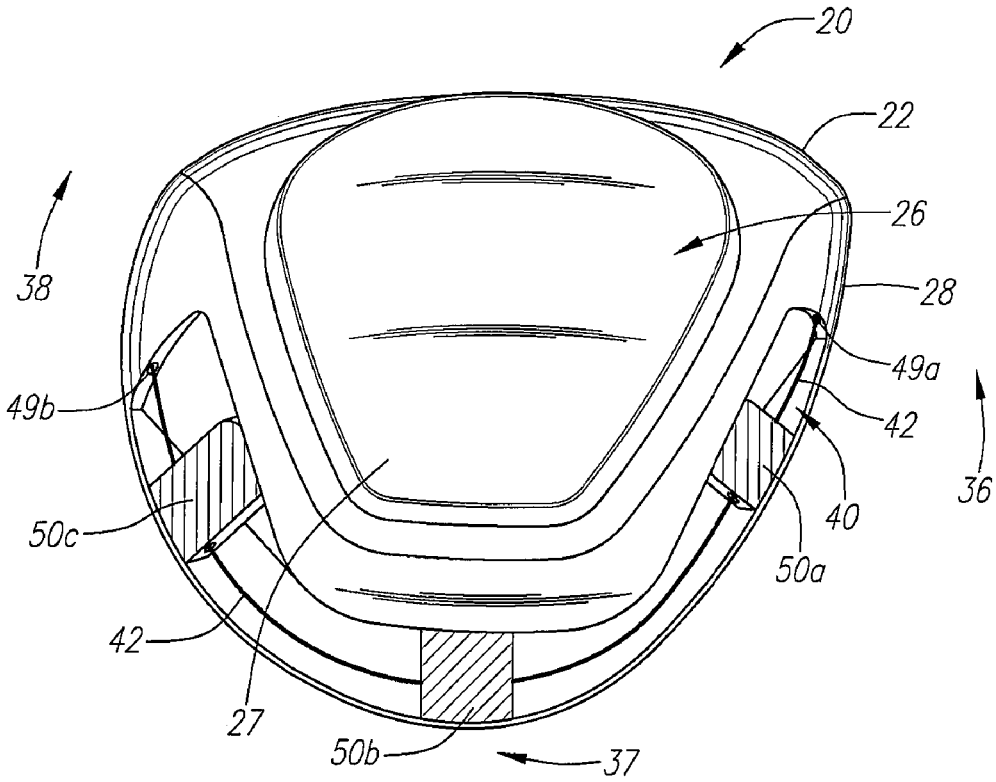
FIG. 7 is a bottom view of the golf club head of FIG. 1.
Figure 8:
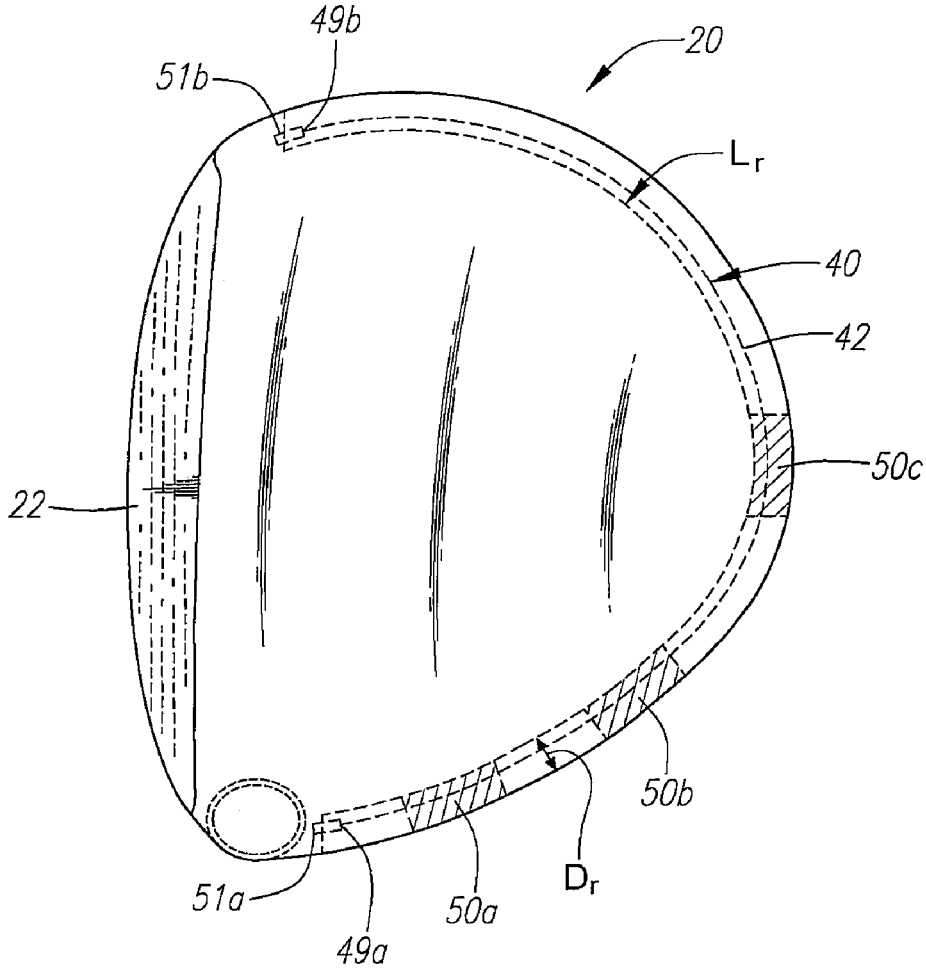
FIG. 8 is a top plan view of a golf club head of the present invention illustrating a recess, a cable and placement of weights in phantom lines.

As shown in FIGS. 1–8, a golf club head is generally designated 20. The golf club head 20 of FIGS. 2–6 is a fairway wood, however, the golf club head 20 of the present invention may alternatively be a driver. The golf club head 20 has a body 22 that is preferably composed of a metal material such as titanium, titanium alloy, stainless steel, or the like, and is most preferably composed of a cast stainless steel material. The body 22 is preferably cast from molten metal in a method such as the well-known lost-wax casting method. The metal for casting is preferably is composed of 17-4 steel alloy. Alternatively the body 22 is composed of a titanium or a titanium alloy such as 6-4 titanium alloy, alpha-beta titanium alloy or beta titanium alloy for forging, and 6-4 titanium for casting. Additional methods for manufacturing the body 22 include forming the body 22 from a flat sheet of metal, super-plastic forming the body 22 from a flat sheet of metal, machining the body 22 from a solid block of metal, electrochemical milling the body from a forged pre-form, and like manufacturing methods.

The golf club head 20 preferably has a volume from 100 cubic centimeters to 600 cubic centimeters, more preferably from 130 cubic centimeters to 475 cubic centimeters. When designed as a fairway wood, the golf club head 20 preferably has a volume ranging from 130 cubic centimeters to 300 cubic centimeters, and more preferably from 150 cubic centimeters to 275 cubic centimeters. The volume of the golf club head 20 will also vary between fairway woods (preferably ranging from 3-woods to eleven woods). When designed as a driver, the golf club head 20 preferably has a volume ranging from 300 cubic centimeters to 500 cubic centimeters, and more preferably from 350 cubic centimeters to 475 cubic centimeters.

The golf club head 20 preferably has a mass ranging from 90 grams to 250 grams, more preferably from 150 grams to 225 grams, and most preferably from 180 grams to 221 grams. The mass of the golf club head 20 will also vary between fairway woods (preferably ranging from 3-woods to eleven woods) and a driver.

In a preferred embodiment, the body 22 has a crown 24, a sole 26 with a bottom portion 27 and a ribbon portion 28, and a striking plate 30. The body 22 preferably has a hollow interior. The golf club head 20 has a heel end 36, a toe end 38 an aft end 37. A shaft 21, partially shown in FIG. 1, is placed within a hosel 39 at the heel end 36. In a preferred embodiment, the hosel is internal 39 to the body 22, and the shaft extends to the sole 26. Alternatively, the hosel 39 is an exterior hosel and a butt end of the shaft 21 is placed therein.

The body preferably has a recess 40, which preferably is an arc-like recess extending from a heel end 36 of the body 22 to a toe end 38 of the body 22. In alternative embodiments, the recess extends along only a portion of body 22. Preferably, the recess 40 is located along the ribbon portion 28 of the sole 26. The recess 40 preferably has a height, "Hr" (shown in FIG. 3), ranging from 0.5 centimeter to 4.0 centimeters, a depth, "Dr" (shown in FIG. 8), ranging from 0.2 centimeter to 2.0 centimeters, and an arc length "Lr" (dashed line shown in FIG. 8), ranging from 2 centimeters to 20 centimeters. More preferably, the recess 40 has a height, Hr, ranging from 1.0 centimeter to 2.0 centimeters, a depth, Dr, ranging from 0.5 centimeter to 1.0 centimeter, and an arc length Lr, ranging from 10 centimeters to 15 centimeters.

In a preferred embodiment, the body 22 has a cable 42 extending within the recess 40. In a preferred embodiment, the cable 42 is composed of a metal material such as steel, titanium, titanium alloy, brass, tin, aluminum, aluminum alloy or other like materials. The cable 42 preferably has a diameter ranging from 0.1 centimeter to 0.5 centimeter. The cable is preferable connected to the body 22 by a first threaded bolt 49*a* and a second threaded bolt 49*b*. The first threaded bolt 49*a* is secured within a threaded aperture 51*a* of the body 22 at the heel end 36 of the recess 40. The second threaded bolt 49*b* is secured within a threaded aperture 51*b* of the body 22 at the toe end 38 of the recess 40. Preferably, each end of the cable 42, heel end and toe end, has a loop for placement of a bolt 49 therethrough for securing the cable 42 to the body 22. Each of the bolts 49*a* and 49*b* is preferably composed of a stainless steel material. Those skilled in the pertinent art will recognize alternative methods of securing the cable 42 to the body 22 within the recess 40.

At least one weight member 50 is preferably secured to cable 42 within the recess 40. The weight member 50 is preferably composed of a high density material having a density greater than the density of a typical club head material, such as steel (density of 7.87 g/cc), or titanium (density of 4.51 g/cc). Preferably, the weight member 50 is composed of tungsten (density of 19.25 g/cc), copper (density of 8.93 g/cc), gold (density of 19.28 g/cc), silver (density of 10.50 g/cc), palladium (density of 12.00 g/cc), platinum (density of 21.47 g/cc) or another similar material. A preferred material for the weight member 30 is tungsten or tungsten alloy. An alternative material is a nickel-tungsten-chromium alloy such as disclosed in U.S. patent application Ser. No. 10/604,518, filed on Jul. 28, 2003 for a High Density Alloy For Improved Mass Properties In An Article, assigned to Callaway Golf Company of Carlsbad, Calif., and hereby incorporated by reference in its entirety. The weight member 50 preferably has a thickness ranging from 0.2 centimeter to 2.0 centimeters, a height ranging from 0.5 centimeter to 4.0 centimeters and a length ranging from 1.0 centimeter to 5.0 centimeters. More preferably, the weight member 50 has a thickness ranging from 0.5 centimeter to 1.0 centimeters, a height ranging from 1.0 centimeter to 2.0 centimeters and a length ranging from 2.5 centimeter to 4.0 centimeters. The weight member preferably has a mass ranging from 5 grams to 25 grams, more preferably from 7 grams to 20 grams and most preferably 10 grams.

In a preferred embodiment, the golf club head 20 preferably has a three weight members 50*a*, 50*b* and 50*c*. Each of the weight members 50 preferably has a body 53 with an aperture 52 for placement of the cable 42 therethrough.

Figure 9:
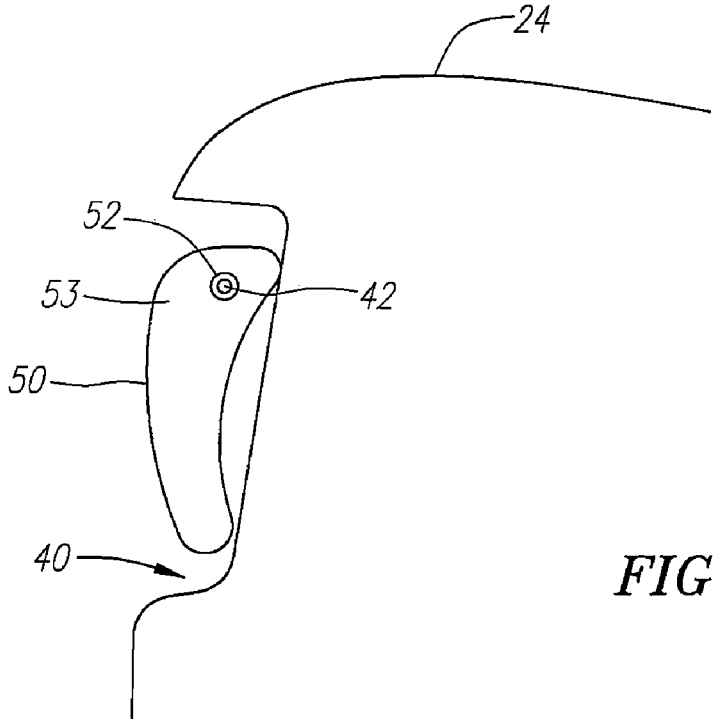
FIG. 9 is an isolated view of a weighting member in a locked position.
Figure 10:
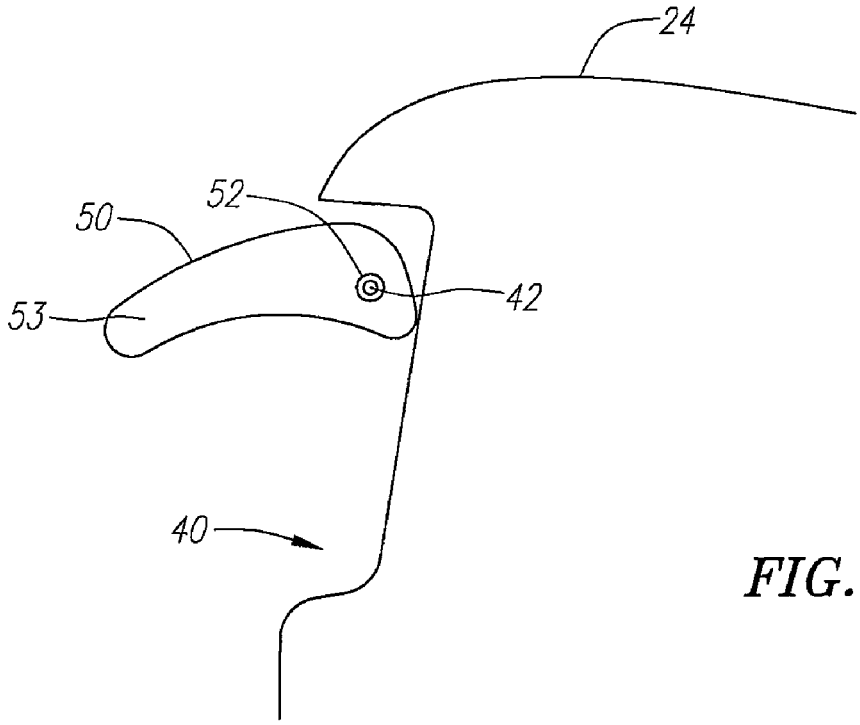
FIG. 10 is an isolated view of the weighting member in an unlocked position.
Figure 11:
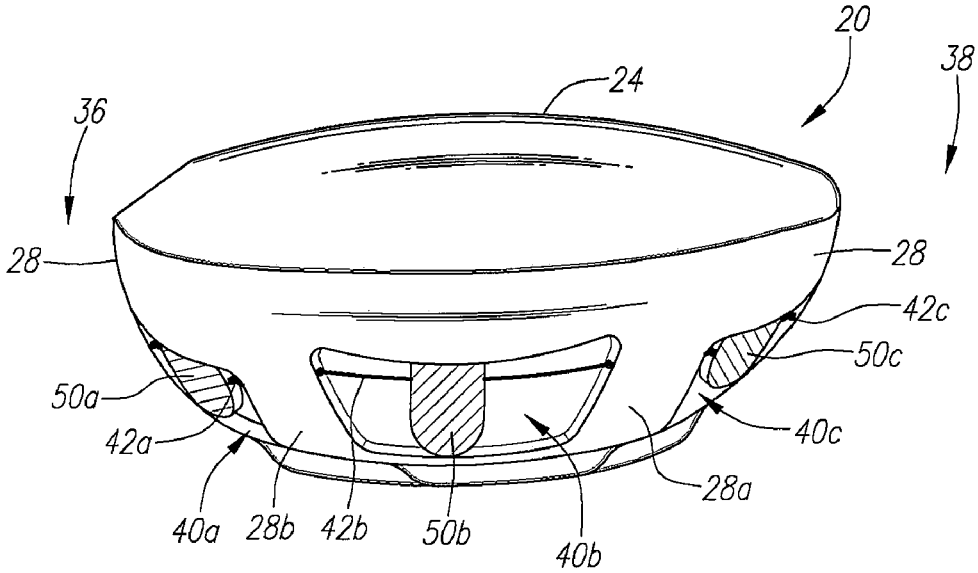
FIG. 11 is a rear view of an alternative embodiment of a golf club head of the present invention.
Figure 12:
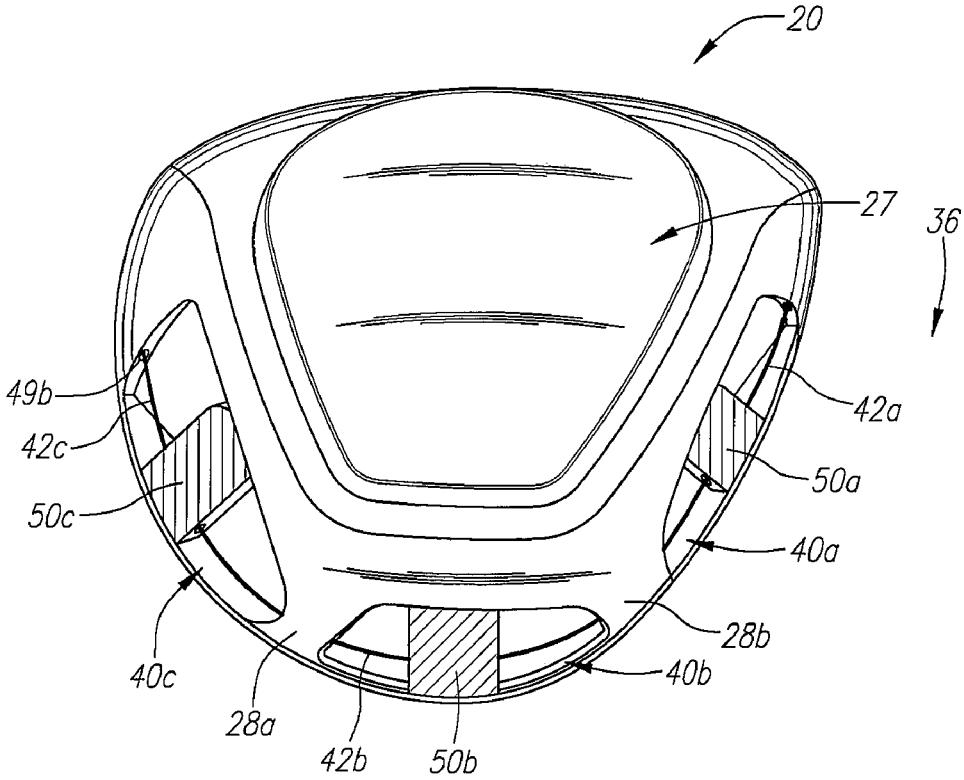
FIG. 12 is a bottom view of the golf club head of FIG. 11.
Figure 13:
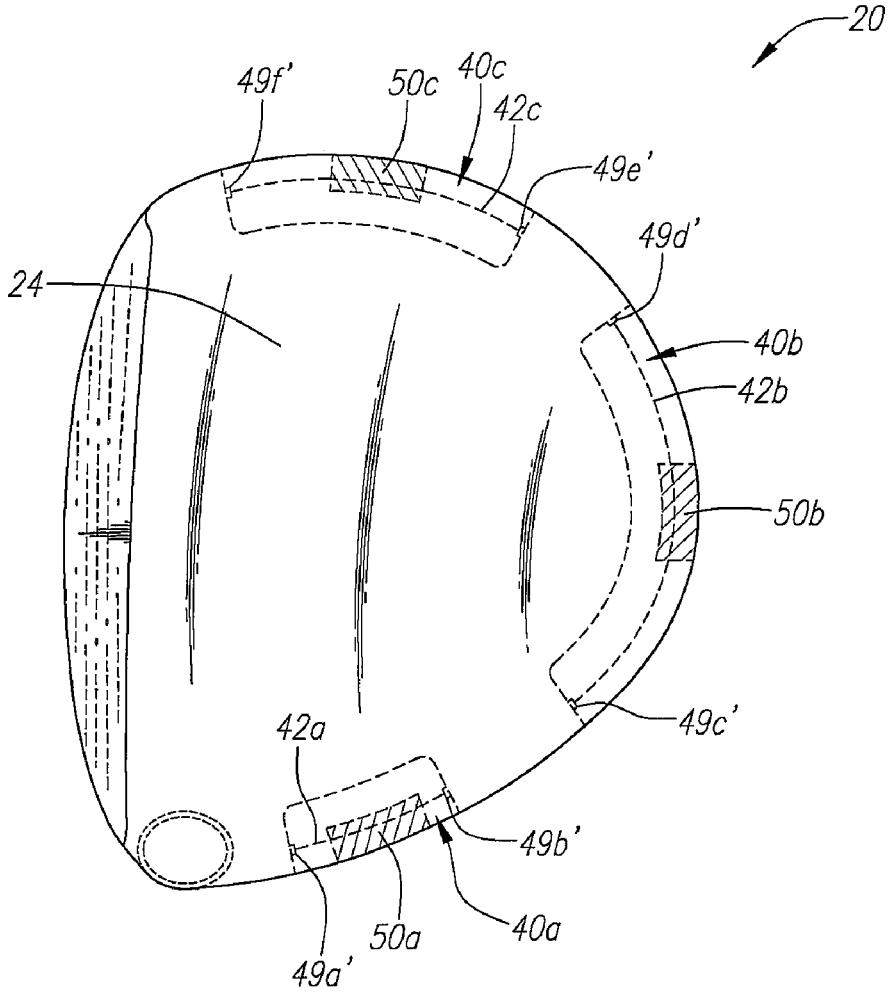
FIG. 13 is a top plan view of a golf club head of FIG. 11 illustrating the recesses, the cables and placement of weights in phantom lines.

As shown in FIG. 9, in an unlocked position, the weight member 50 has the cam nut extending outward and the body 51 of the weight member 50 is free to move along the recess with each locking projection 55 moving along a corresponding arc-like track 42*a* and 42*b*. In this manner, a golfer may adjust the position of the weight member 50 to influence the center of gravity of the golf club head 20 and also the golf club 10. A desired center of gravity location of a golf club for a golfer may be selected from the group of far heel ward, mid-heel ward, slight heel ward, neutral, slight toe ward, mid-toe ward and far toe ward. Once a location is determined, the cam nut is secured inward and the bushing engages the wall of the body 22, as shown in FIG. 10. Each of the projections 55 is secured within a locking notch 44. The cam nut may be secured using a wrench, screwdriver or similar tool. In a preferred embodiment, the movement of the weight member from a far toe-ward position to a far heel ward position can move the center of gravity of the golf club head a distance of at least 0.254 centimeters. This movement can greatly change the ball flight characteristic for the golfer, enabling the golfer, or an instructor, the fit the golf club to the golfers ball striking abilities.

In determining a golfer's ball striking abilities, a method and system such as disclosed in U.S. Pat. No. 6,821,209 for a Method For Predicting A Golfer's Ball Striking Performance, assigned to Callaway Golf Company of Carlsbad, Calif., which is hereby incorporated by reference in its entirety.

In an alternative embodiment shown in FIGS. 11–15, the golf club head 20 has a plurality of recesses 40*a*, 40*b* and 40*c* and with a single weight member 50*a*, 50*b* or 50*c* located in each of the recesses 40*a*, 40*b* and 40*c*. Each recess 40*a*, 40*b* and 40*c* is preferably located on the ribbon 28, and a pair of ribbon columns 28*a* and 28*b* define the recesses 40*a*, 40*b* and 40*c*. each of the recesses 40*a*, 40*b* and 40*c* preferably has a height, "Hr", ranging from 0.5 centimeter to 4.0 centimeters, a depth, "Dr", ranging from 0.2 centimeter to 2.0 centimeters, and an arc length "Lr", ranging from 2 centimeters to 7 centimeters.

Each of the recesses 40*a*, 40*b* and 40*c* has a cable 42*a*, 42*b* and 42*c* extending from one end of the recess 40*a*, 40*b* or 40*c*, to the other end of the recess 40*a*, 40*b* or 40*c*. In a first recess 40*a*, the cable 42*a* is preferable connected to the body 22 by a first threaded bolt 49'*a* and a second threaded bolt 49'*b*. The first threaded bolt 49'*a* is secured within a threaded aperture 51'*a*, not shown, of the body 22 at a heel end of the recess 40*a*. The second threaded bolt 49'*b* is secured within a threaded aperture 51'*b*, not shown, of the body 22 at an aft end of the recess 40*a*. Preferably, each end of the cable 42*a*, heel end and aft end, has a loop for placement of a bolt 49 therethrough for securing the cable 42*a* to the body 22.

Likewise, in a second recess 40*b*, the cable 42*b* is preferable connected to the body 22 by a first threaded bolt 49'*c* and a second threaded bolt 49'*d*. The first threaded bolt 49'*c* is secured within a threaded aperture 51'*c*, not shown, of the body 22 at an aft-heel end of the recess 40*b*. The second threaded bolt 49'*d* is secured within a threaded aperture 51'*d*, not shown, of the body 22 at an aft-toe end of the recess 40*b*. Preferably, each end of the cable 42*b*, aft-heel end and aft-toe end, has a loop for placement of a bolt 49 therethrough for securing the cable 42*b* to the body 22.

Likewise, in a third recess 40*c*, the cable 42*c* is preferable connected to the body 22 by a first threaded bolt 49'*e* and a second threaded bolt 49'*f*. The first threaded bolt 49'*e* is secured within a threaded aperture 51'*e*, not shown, of the body 22 at an aft end of the recess 40*c*. The second threaded bolt 49'*f* is secured within a threaded aperture 51'*f*, not shown, of the body 22 at a toe end of the recess 40*c*. Preferably, each end of the cable 42*c*, aft end and toe end, has a loop for placement of a bolt 49 therethrough for securing the cable 42*c* to the body 22.

Each of the bolts 49 is preferably composed of a stainless steel material. Those skilled in the pertinent art will recognize alternative methods of securing the cables 42*a*, 42*b* and 42*c* to the body 22 within each of the recesses 40*a*, 40*b* and 40*c*.

Figure 14:
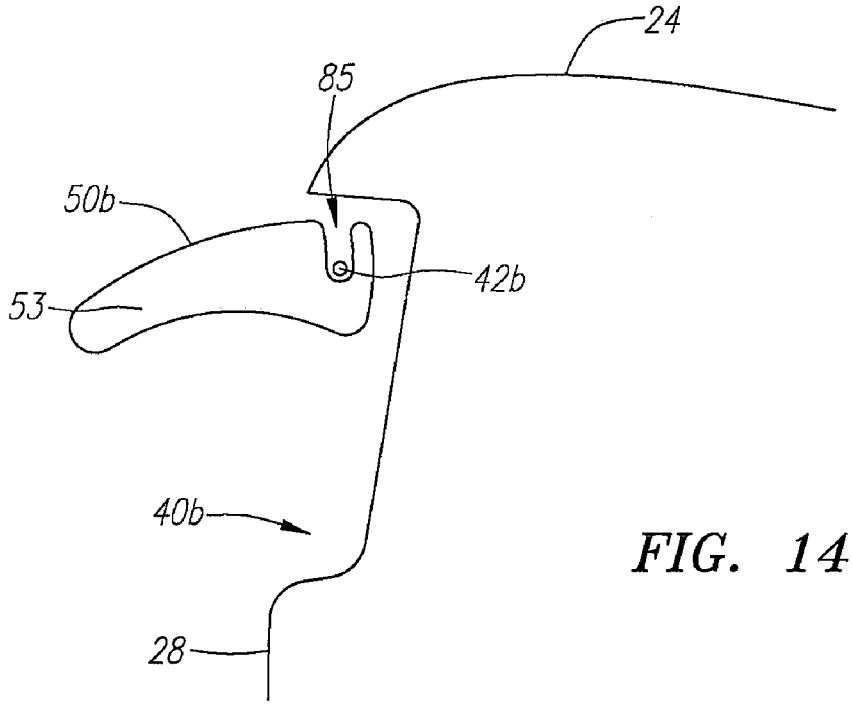
FIG. 14 is an isolated view of a weighting member in an unlocked position.
Figure 15:
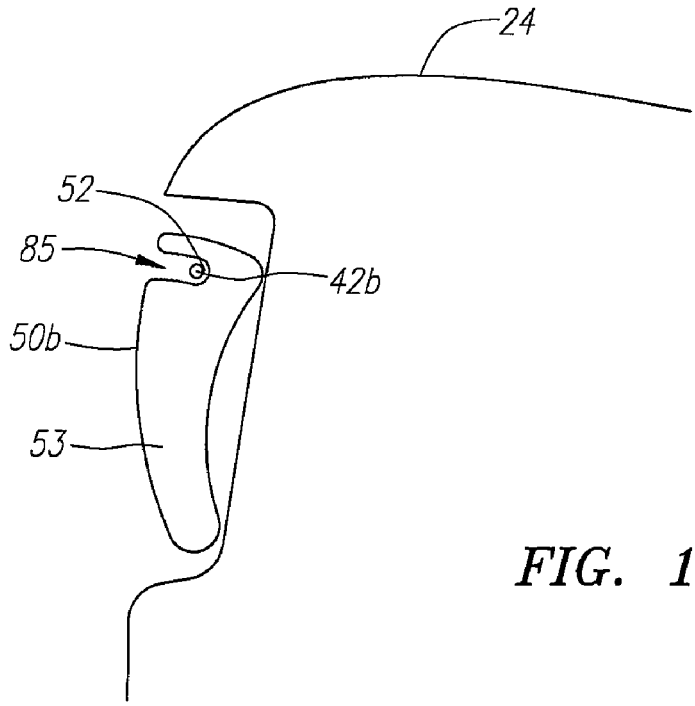
FIG. 15 is an isolated view of the weighting member in a locked position.

As shown in FIGS. 14 and 15, each of the weight members 50*a*, 50*b* and 50*c* of this alternative embodiment has a slot 85 in the body 53 to allow for connection to each of the cables 42*a*, 42*b* and 42*c*. In this manner, each of the weight members 50*a*, 50*b* and 50*c* are attached to each of the cables 42*a*, 42*b* and 42*c* and moved within each of the recesses 40*a*, 40*b* and 40*c* to adjust the mass properties of the golf cub head 20 for a particular golfer.

The golf club head 20 preferably has a high coefficient of restitution thereby enabling for greater distance of a golf ball hit with the golf club of the present invention. The coefficient of restitution (also referred to herein as "COR") is determined by the following equation:

$$e = \frac{v_2 - v_1}{U_1 - U_2}$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The present invention provides a golf club head 20 having a coefficient of restitution ranging from 0.81 to 0.94, as measured under conventional test conditions, and more preferably from 0.825 to 0.85.

FIGS. 14 and 15 illustrate the axes of inertia through the center of gravity of the golf club head. The axes of inertia are designated X, Y and Z. The X axis extends from the striking plate section 72 through the center of gravity, CG, and to the rear of the golf club head 20. The Y axis extends from the toe end 68 of the golf club head 20 through the center of gravity, CG, and to the heel end 66 of the golf club head 20. The Z axis extends from the crown section 62 through the center of gravity, CG, and to the sole section 76.

As defined in *Golf Club Design, Fitting, Alteration & Repair,* 4$^{th}$ Edition, by Ralph Maltby, the center of gravity, or center of mass, of the golf club head is a point inside of the club head determined by the vertical intersection of two or more points where the club head balances when suspended. A more thorough explanation of this definition of the center of gravity is provided in *Golf Club Design, Fitting, Alteration & Repair.*

Figure 16:
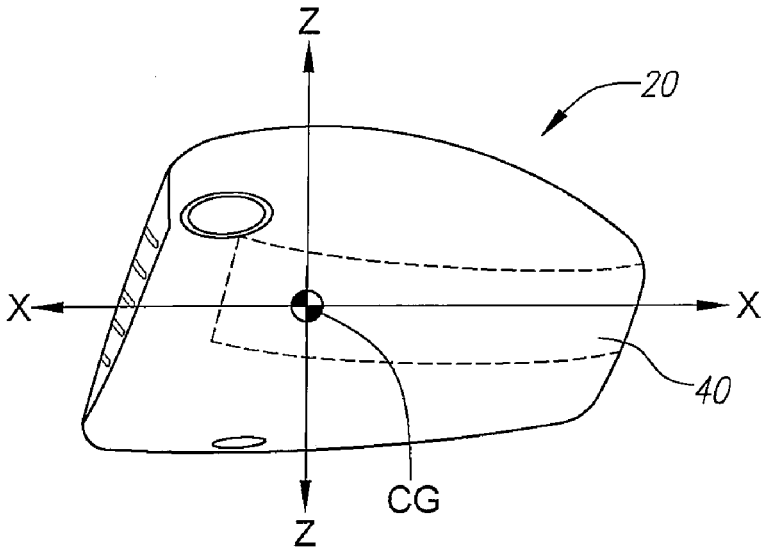
FIG. 16 is a side view of a golf club head illustrating a position of the center of gravity of the golf club head and a Z axis and X axis therethrough.
Figure 17:
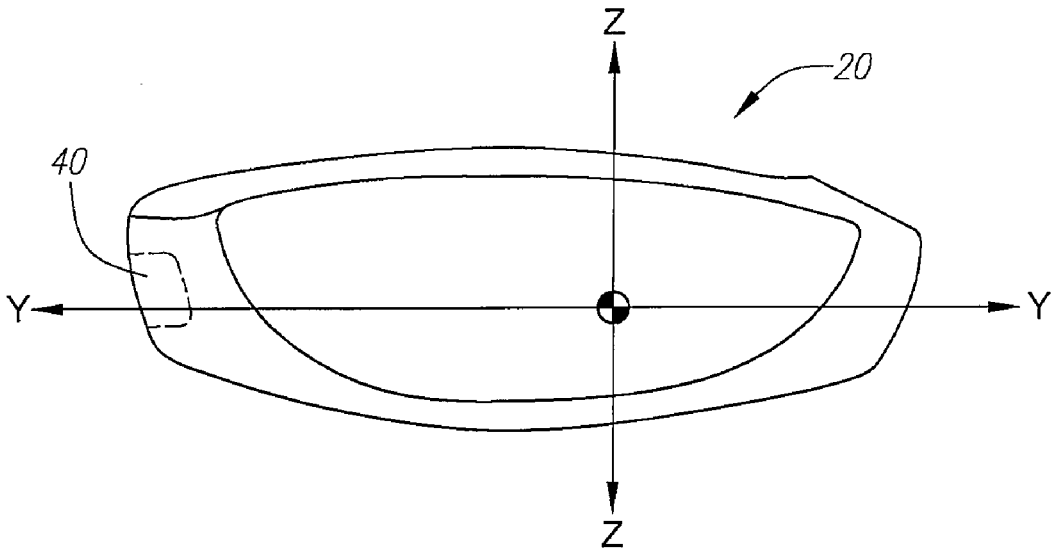
FIG. 17 is a front view of a golf club head illustrating a position of the center of gravity of the golf club head and a Z axis and Y axis therethrough.
Figure 18:
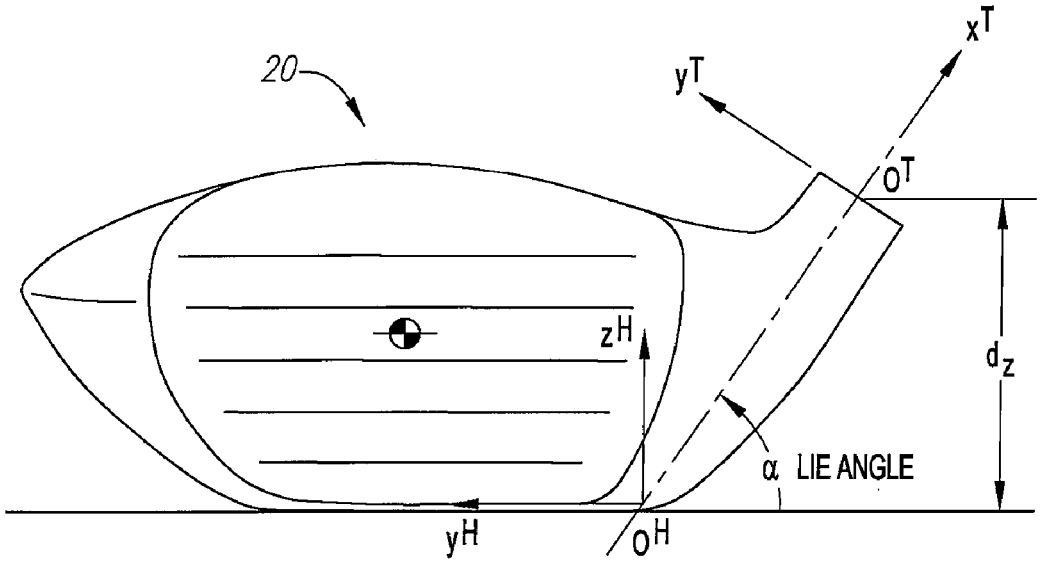
FIG. 18 is a front plan view of a golf club of the present invention illustrating the test frame coordinates $X^T$ and $Y^T$ and transformed head frame coordinates $Y^H$ and $Z^H$.
Figure 19:
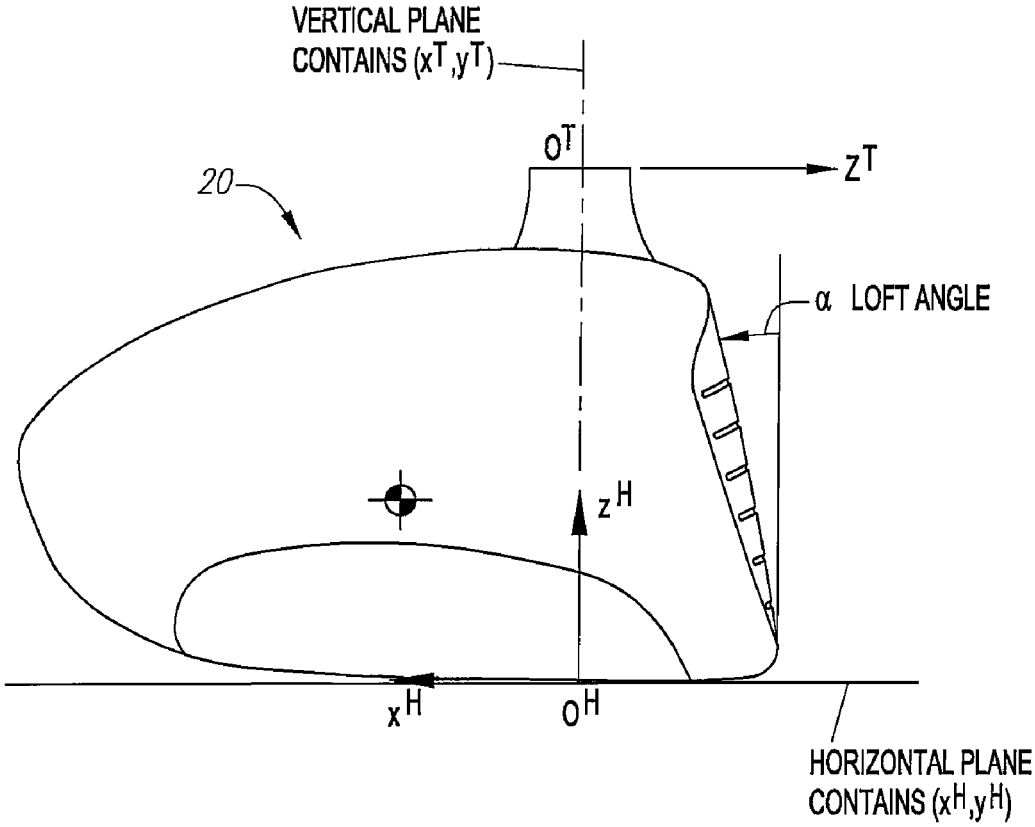
FIG. 19 is a toe end view of the golf club of the present invention illustrating the test frame coordinate $Z^T$ and transformed head frame coordinates $X^H$ and $Z^H$.

The center of gravity and the moment of inertia of a golf club head 20 are preferably measured using a test frame ($X^T$, $Y^T$, $Z^T$), and then transformed to a head frame ($X^H$, $Y^H$, $Z^H$), as shown in FIGS. 16 and 17. The center of gravity of a golf club head may be obtained using a center of gravity table having two weight scales thereon, as disclosed in U.S. Pat. No. 6,607,452, entitled High Moment Of Inertia Composite Golf Club, and hereby incorporated by reference in its entirety.

In general, the moment of inertia, Izz, about the Z axis for the golf club head 20 of the present invention will range from 1900 g-cm$^2$ to 4000 g-cm$^2$, preferably from 2000 g-cm$^2$ to 3500 g-cm$^2$, and most preferably from 2500 g-cm$^2$ to 3000 g-cm$^2$. The moment of inertia, Iyy, about the Y axis for the golf club head 20 of the present invention will range from 900 g-cm$^2$ to 1700 g-cm$^2$, preferably from 950 g-cm$^2$ to 1500 g-cm$^2$, and most preferably from 965 g-cm$^2$ to 1200 g-cm$^2$.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

What is claimed is:

1. A golf club head comprising:

a body having a face, a crown and a sole, the body having an arc-like recess extending from a heel end of the body to a toe end of the body;

a cable extending from a heel end of the arc-like recess to a toe-end of the arc-like recess, the cable connected to the body at the heel end of the arc-like recess and at the TOE-END of the arc-like recess;

at least one weight member attached to the cable within the arc-like recess and movable along the cable within the arc-like recess, the at least one weight member capable of movement about the cable from a locked position to a movement position.

2. The golf club head according to claim 1 wherein the at least one weight member comprises a body that is composed of a material having a density greater than the density of the material of the body of the golf club head.

3. The golf club head according to claim 1 wherein the at least one weight member comprises a body that is composed of a tungsten material and the body of the golf club head is composed of a stainless steel material.

4. The golf club head according to claim 1 further comprising a second weight member attached to the cable within the arc-like recess and movable along the cable within the arc-like recess, the second weight member capable of movement about the cable from a locked position to a movement position.

5. The golf club head according to claim 4 wherein each of the at least one weight member and the second weight member is composed of a nickel-tungsten chromium alloy material.

6. The golf club head according to claim 1 wherein the sole of the body comprises a ribbon portion and a bottom portion, and wherein the recess is located along the ribbon portion and the recess has a height ranging from 0.5 centimeter to 4.0 centimeters, a depth ranging from 0.2 centimeter to 2.0 centimeter, and an arc length ranging from 2 centimeters to 20 centimeters.

7. The golf club head according to claim 6 wherein the at least one weight member has a thickness ranging from 0.2 centimeter to 2.0 centimeters, a height ranging from 0.5 centimeter to 4.0 centimeters and a length ranging from 1.0 centimeter to 5.0 centimeters.

8. The golf club head according to claim 1 wherein the at least one weight member has a mass ranging from 5 grams to 25 grams.

9. The golf club head according to claim 8 wherein the body of the golf club head has a mass ranging from 90 grams to 250 grams.

10. A golf club head comprising:

a body having a face, a crown and a sole with a ribbon portion and a bottom portion, the body having an arc-like recess extending from a heel end of the body to a toe end of along the ribbon portion of the sole, the body composed of a titanium alloy material and having a volume ranging from 130 cubic centimeters to 475 cubic centimeters and a mass ranging from 180 grams to 250 grams; and a cable extending from a heel end of the arc-like recess to a toe-end of the arc-like recess, the cable connected to the body at the heel end of the arc-like recess and at the toe-end of the arc-like recess;

a plurality of weight members attached to the cable within the arc-like recess and movable along the cable within the arc-like recess, each of the plurality of weight members capable of movement about the cable from a locked position to a movement position.

11. The golf club head according to claim 10 wherein the recess has a height ranging from 0.5 centimeter to 4.0 centimeters, a depth ranging from 0.2 centimeter to 2.0 centimeter, and an arc length ranging from 2 centimeters to 20 centimeters.

12. The golf club head according to claim 10 wherein each of the plurality of weight members has a mass ranging from 5 grams to 25 grams.

13. The golf club head according to claim 10 wherein the position of the plurality of weight members can adjust the position of the center of gravity of the golf club head.

14. The golf club head according to claim 10 wherein each of the weight members has a thickness ranging from 0.2 centimeter to 2.0 centimeters, a height ranging from 0.5 centimeter to 4.0 centimeters and a length ranging from 1.0 centimeter to 5.0 centimeters.

15. The golf club head according to claim 10 wherein the body is composed of a material selected from the group consisting of steel alloys, titanium alloys, titanium, magnesium, magnesium alloys, aluminum and aluminum alloys.

16. The golf club head according to claim 10 wherein the arc-like recess of the body extends along 50% to 95% of the arc-length of the ribbon portion.

17. The golf club head according to claim 10 wherein the plurality of weight members has a mass ranging from 5% to 25% of the mass of the golf club head.

18. The golf club head according to claim 10 wherein the cable is composed of steel and has a diameter ranging from 0.1 centimeter to 0.5 centimeter.

19. The golf club head according to claim 10 further comprising connection means for connecting the cable to the body, the connection means comprising a first threaded bolt placed through a first loop at a heel end of the cable and threadingly connected into a first aperture in the body of the club head and a second threaded bolt placed through a second loop at a toe end of the cable and threadingly connected into a second aperture in the body of the club head.

20. A method for providing a golfer with a golf club having a center of gravity oriented for the golfer, the method comprising:

determining a desired center of gravity location of a golf club for a golfer from the group of far heel ward, mid-heel ward, slight heel ward, neutral, slight toe ward, mid-toe ward and far toe ward;

positioning a plurality of weight members locations to achieve the desired center of gravity location, the golf club comprising a golf club head comprising a body having a face, a crown and a sole, the body having an arc-like recess extending from a heel end of the body to a toe end of the body, a cable extending from a heel end of the arc-like recess to a toe-end of the arc-like recess, the cable connected to the body at the heel end of the arc-like recess and at the TOE-END of the arc-like recess, each of the plurality of weight members attached to the cable within the arc-like recess and movable along the cable within the arc-like recess, each of the plurality of weight members capable of movement about the cable from a locked position to a movement position.

* * * * *